United States Patent [19]

Collins

[11] 4,265,017

[45] May 5, 1981

[54] POCKET KNIFE WITH RETRACTABLE BLADE

[75] Inventor: Walter W. Collins, Rock Hill, S.C.

[73] Assignee: Jenkins Metal Corporation, Gastonia, N.C.

[21] Appl. No.: 73,266

[22] Filed: Sep. 7, 1979

[51] Int. Cl.[3] ..... B26B 1/00

[52] U.S. Cl. ..... 30/162

[58] Field of Search ..... 30/162, 163, 154

[56] References Cited

U.S. PATENT DOCUMENTS

| | | | |
|---|---|---|---|
| 515,743 | 3/1894 | Bultzingslowen | 30/163 |
| 569,452 | 10/1896 | Gardner | 30/163 |
| 1,960,130 | 5/1934 | Trubel | 30/162 X |
| 4,063,356 | 12/1977 | Hepworth | 30/162 |

FOREIGN PATENT DOCUMENTS

| | | | |
|---|---|---|---|
| 1122971 | 5/1956 | France | 30/162 |

*Primary Examiner*—Jimmy C. Peters

*Attorney, Agent, or Firm*—Clifton T. Hunt

[57] ABSTRACT

A pocket knife with a retractable blade wherein a blade is mounted within the handle for generally axial reciprocatory movement to operative position beyond one end of the handle and inoperative position within the handle. A novel pivotally mounted leaf spring cooperates with a suitably shaped trackway to positively support and lock the knife blade in each of its extreme positions.

14 Claims, 10 Drawing Figures

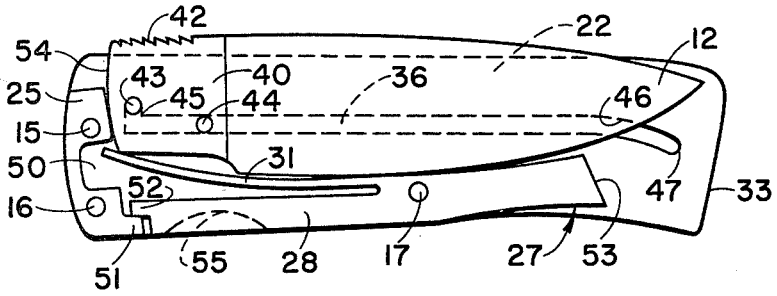
FIG. 5
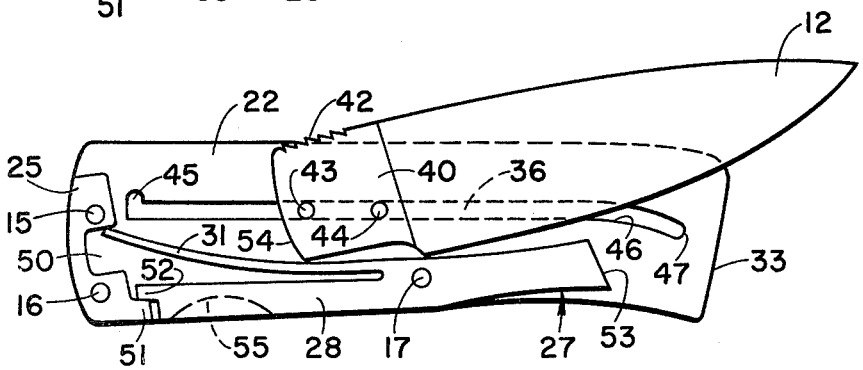
FIG. 6
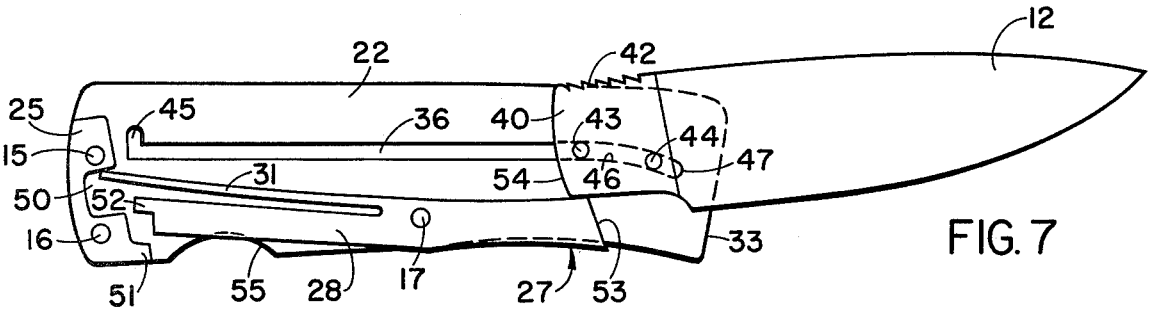
FIG. 7
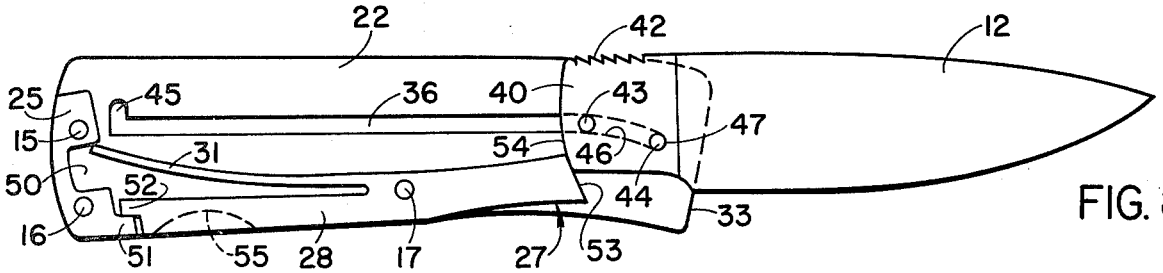
FIG. 8
FIG. 9
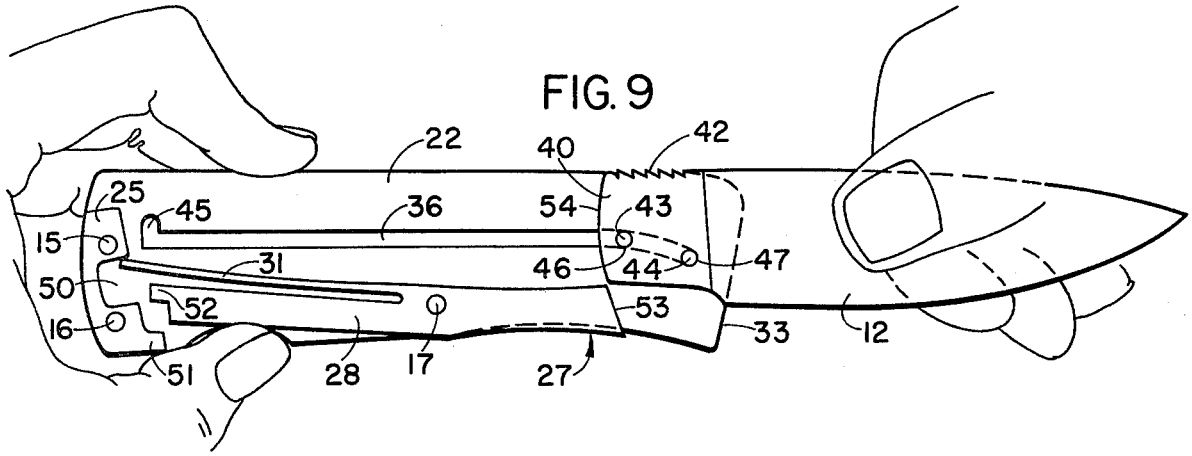

POCKET KNIFE WITH RETRACTABLE BLADE

BACKGROUND OF THE INVENTION

Knives with retractable blades have long been known. See, for example, U.S. Pat. No. 845,792 issued Mar. 5, 1907 to Luther E. Jenkins; U.S. Pat. No. 2,640,260 issued June 2, 1953 to Clarence E. Taylor et al; and U.S. Pat. No. 3,025,598 issued Mar. 20, 1962 to Warren I. Nissen. Each of these knives has a disadvantage which is overcome by the knife of the present invention. In Jenkins the knife is fastened to one end of a spring coiled within the handle and when the spring is activated it projects the knife blade outwardly beyond one end of the handle. The spring contracts when the knife blade is pushed back into the handle. Difficulty has been encountered with the Jenkins knife because the coil spring is easily subject to becoming fouled, rendering the knife useless.

Taylor et al discloses a retractable pocket knife which eliminates the coiled spring of Jenkins and the consequent danger of the spring becoming fouled. Taylor et al does not have any means for positively locking the knife blade in either open or closed position. Instead, frictional resistance is provided by the pressure exerted by a spring pressed actuating button to frictionally retain the knife blade in a desired position. This is dangerous because of the possibility that the blade may be unintentionally dislodged if jammed against something.

U.S. Pat. No. 3,025,598 to Nissen discloses a knife with a retractable blade utilizing a carrier and a guide within the handle to selectively move the blade between open and closed position. In Nissen it is the carrier which is manipulated to move the blade which is more cumbersome and less reliable than the operator being able to grasp the blade and move it as desired between open and closed position as in the present invention.

SUMMARY OF THE INVENTION

According to the present invention the knife blade is supported by a pair of guide pins movable along a generally axial trackway defined in liners on either side of the blade within the handle. The trackway is appropriately shaped at each end to define stop positions which cooperate with a pivoted leaf spring to positively lock the blade in its closed or inoperative position and to positively lock the blade in its operative or extended position. The knife is selectively moved between said extreme positions by overcoming the spring sufficiently to move one of the guide pins out of a stop position to overcome the positive lock and into the trackway whereby the blade may be manually moved to the opposite extreme position at which point the outer guide pin is automatically urged into a stop position by the spring without attention by the operator.

It is an object of the invention to provide a knife with a retractable blade wherein the blade may be freely moved between two extreme positions and positively locked into either of the extreme positions as desired, preventing accidental displacement of the blade.

It is another object of this invention to provide a knife of the type described which functions easily and reliably with a minimum of machined parts and a minimum of moving parts to locate the knife blade in a desired position relative to the handle and to positively lock the blade in a desired position automatically without attention by the operator.

BRIEF DESCRIPTION OF THE DRAWINGS

FIGS. 5–8 are sequential somewhat schematic views showing the blade and selected parts of the invention but omitting the handles and one liner of the knife for clarity to illustrate the interaction of the blade and spring as the guide pins traverse the trackway between the extreme closed position of FIG. 5 and the extreme open position of FIG. 8;

FIG. 9 is a view similar to FIG. 8, but illustrating the manipulation of the blade and spring to unlock the blade from the fully extended stop position preparatory to retracting the blade.

DETAILED DESCRIPTION OF THE INVENTION

Figure 4:
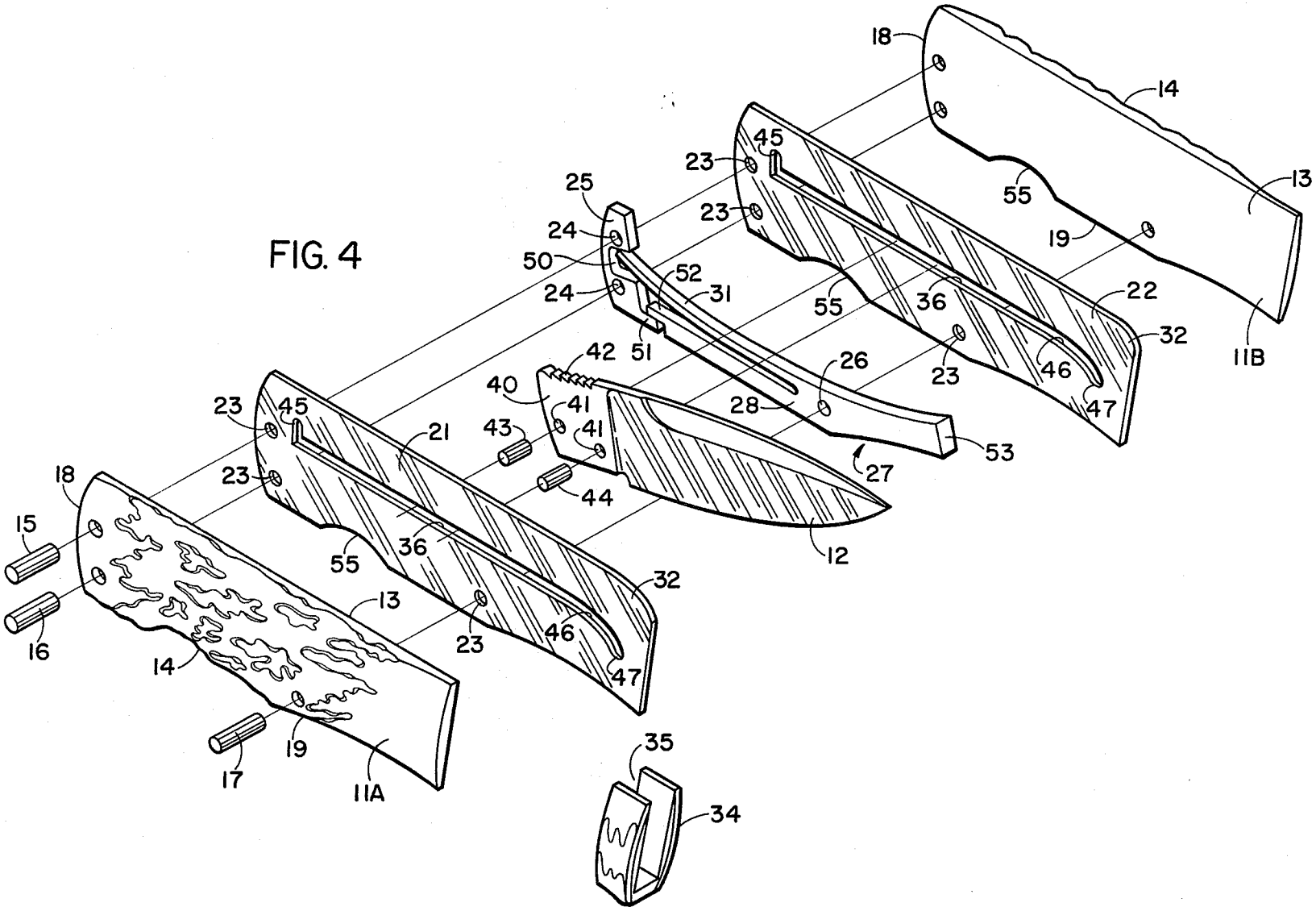
FIG. 4 is an exploded perspective view illustrating the manner of assembling the components of the knife.

Referring more specifically to the drawings, the numeral 10 broadly designates a knife having a handle 11 and a blade 12. As most clearly seen in FIG. 4, the handle 11 is defined by two pieces of shaped material 11A and 11B each having a smooth inner surface 13 and a desirably textured outer surface 14. The handle portions 11A and 11B may be formed from bone, plastic, wood or such other material as desired.

The handle portions 11A and 11B are held together by pins or brads 15, 16 and 17, each of which penetrates the handle portions 11A, 11B and certain other elements of knife 10 as most clearly seen in the drawings. The pins 15, 16 extend laterally through the handle portions 11A and 11B adjacent their base or rear end 18 and the pin 17 penetrates the handle portions 11A, 11B at about their midpoint adjacent their lower edges 19. Each of the pins 15, 16 and 17 is suitably upset or flattened against the outer surfaces 14 of handle portions 11A, 11B to hold them and press their inner surfaces 13 firmly against respective liners 21 and 22 having bores 23 for each of the pins 15, 16 and 17. The pins 15, 16 also extend through bores 24 in a stationary abutment 25 at the rear or base 18 of knife 10. Pin 17 extends through bore 26 in bifurcated spring member 27 which includes a base 28 and a leaf spring 31 formed integral with the base 28. Bore 26 is of slightly larger diameter than pin 17 so that spring 27 is free for pivotal movement about pin 17.

The liners 21 and 22 are formed from any suitable material such as steel and are of identical configuration with their forward ends curving downwardly as at 32 (FIG. 4) and received within bolster 34 formed from a single piece of material and of U-shaped configuration with an opening 35 at its top through which blade 12 passes during its reciprocatory axial movement relative to handle 11.

Blade 12 includes a base 40 having a pair of angularly offset bores 41 and a serrated upper surface 42. A pair of guide pins 43, 44 penetrate respective bores 41 and extend through generally axially extending slots 36 in liners 21 and 22. The guide pins 43, 44 are upset or flattened against the distal or outer surfaces of liners 21 and 22 are fixed against relative movement to butt 40 of blade 20 so that the blade 12 is freely supported for sliding movement between liners 21 and 22 along spring 27 and in advance of abutment 25.

Slots 35 in liners 21 and 22 each extend vertically adjacent the rear 18 of the knife and terminate in a vertical plane as shown in the drawings to define a stop position 45 for guide pin 43 when the blade 12 is fully retracted to the inoperative position of FIG. 5. Slots 36 extend forwardly from seat 45 along a path parallel to the longitudinal axis of knife 10 to a point 46 where they curve downwardly and forwardly in the drawings, terminating at a stop position 47 for guide pin 44 adjacent the front end 33 of the knife.

The abutment 25 has a recess 50 between the bores 24 opening forwardly and within which the free end of leaf spring 31 is received. A leg 51 extends forwardly from base of abutment 25 and serves as a seat for a rearwardly extending projection 52 of base 28 on spring 27. The forward end of spring 27 is biased downwardly and forwardly as at 53 to define a cammed surface over which the butt 40 of the blade 12 rides and against which the rear wall 54 of butt 40 is held in positively locked position when the blade 12 is fully extended to the operative position of FIG. 8.

The handle portions 11A and 11B and the liners 21 and 22 each have corresponding curvalinear recesses in their lower walls to define an opening 55 through which a person's finger may extend to engage the base 28 of spring 27 in manipulating the knife to retract the blade 12 (FIG. 9).

OPERATION

Figure 1:
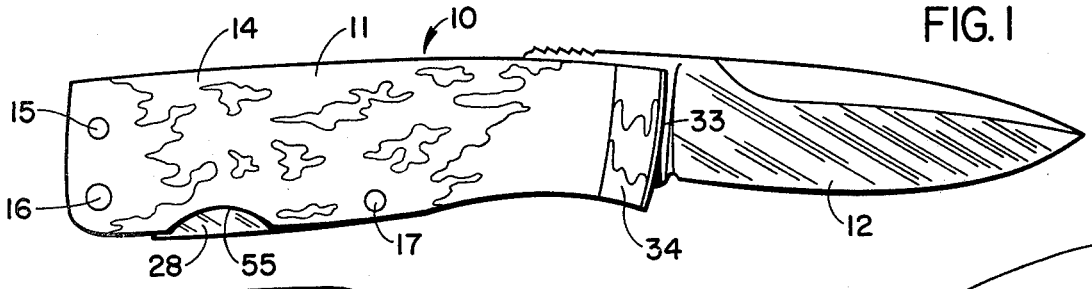
FIG. 1 is a side elevation of the knife with the knife blade moved to its extended or operative position.

The knife is shown in FIGS. 1 and 8 with the blade 12 in its fully extended or operative position, and the knife is shown in FIG. 5 with the blade in the fully retracted or inoperative position. As illustrated in FIG. 5 the lower surface of blade 12 rests against leaf spring 31 depressing it within recess 50 and bringing it into supporting engagement with butt 40 or blade 12. So positioned, leaf spring 31 urges guide pin 43 upwardly above track 36 and into positive locking relation with the vertically extending stop position 45, confining the blade 12 within the handle 11.

Assuming it is desired to move the blade 12 from the closed or inoperative position of FIG. 5, a person places a thumb or finger on the serrated surface 42 on the upper edge of butt 40 of blade 12 and pushed downwardly to overcome leaf spring 31 and move guide pin 43 out of stop position 45 and into the longitudinally extending trackway 36. As shown in FIG. 6 the movement of guide pin 43 into trackway 36 raises the pointed end of blade 12 at an angle relative to handle 11 where it may be easily grasped between the thumb and finger of the operator and pulled forwardly to move the guide pins 43 and 44 along the trackway 36 toward the front 33 of the knife. As the guide pin 44 passes beyond the point 46 where the trackway begins to curve downwardly and forwardly, the angle of the blade 12 relative to handle 11 begins to decrease (FIG. 7) and as the guide pin 44 reaches the stop position 47 at the forward end of the trackway 36 the guide pin 43 arrives at the point 46 and the blade 12 then extends in axial alignment with handle 11 (FIG. 8). The angle of the trackway between points 46 and 47 relative to the main trackway between point 46 and rear stop position 45 corresponds with the angular offset of the guide pins 43, 44 relative to the main portion of trackway 36.

As the blade 12 is drawn forwardly along trackway 36 the lower surface of the butt 40 slides along the leaf spring 31 and as it moves toward the juncture of leaf spring 31 with base 28 of spring 27 the free end of the leaf spring 31 is allowed to return to its normal position in engagement with the upper wall of recess 50 as shown in FIG. 6. The butt 40 always remains in engagement with some portion of spring 27 and as the butt 40 is moved forwardly beyond pivot pin 17 the forward portion of spring 27 is depressed causing it to pivot around pin 17 and elevate base 28 of lift the protuberance 52 above the leg 51 on abutment 25 (FIG. 7). Further forward movement of blade 12 relative to handle 11 brings the forward guide pin 44 to the stop position 47 at the forward end of trackway 35 after the rear wall 54 of butt 40 has passed forwardly beyond the inclined forward wall 53 of spring 27. The release of downward pressure on the forward portion of spring 27 automatically results in reverse pivotal movement of spring 27 about pin 17, elevating the forward portion of spring 27 and bringing the inclined front wall 53 of spring 27 to bear against the rear wall 54 of butt 40 and positively locking the knife blade 12 against retraction into the handle 11. Lateral movement of blade 12 in its fully extended position of FIG. 8 is limited by the liners 21, 22 on either side of the blade 12.

Now, assuming it is desired to move the blade 12 from its fully extended or operative position of FIG. 8 into the closed position of FIG. 5, the blade 12 is grasped in one hand and the handle is grasped in the other hand with the person's thumb or finger in the recess 55 to overcome the leaf spring leg 31 and move the base 28 above the recess 54 (FIG. 9) thereby imparting pivotal movement to spring 27 about pin 17 and lowering the forward wall 53 below butt 40 of blade 12 (FIG. 9). The operator is then enabled to push the blade 12 rearwardly through the positions illustrated in FIGS. 7 and 6 until the blade is in the fully seated position of FIG. 5.

Figure 2:
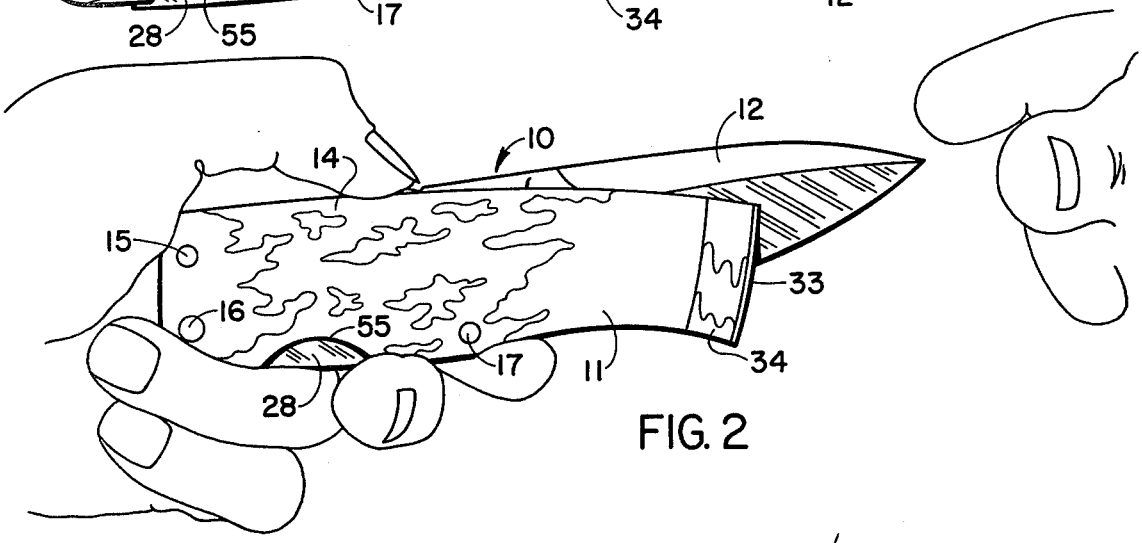
FIGS. 2 and 3 are sequential perspective views of the knife illustrating the manual manipulation of the blade to move it from a closed inoperative position to the open operative position of FIG. 1.
Figure 3:
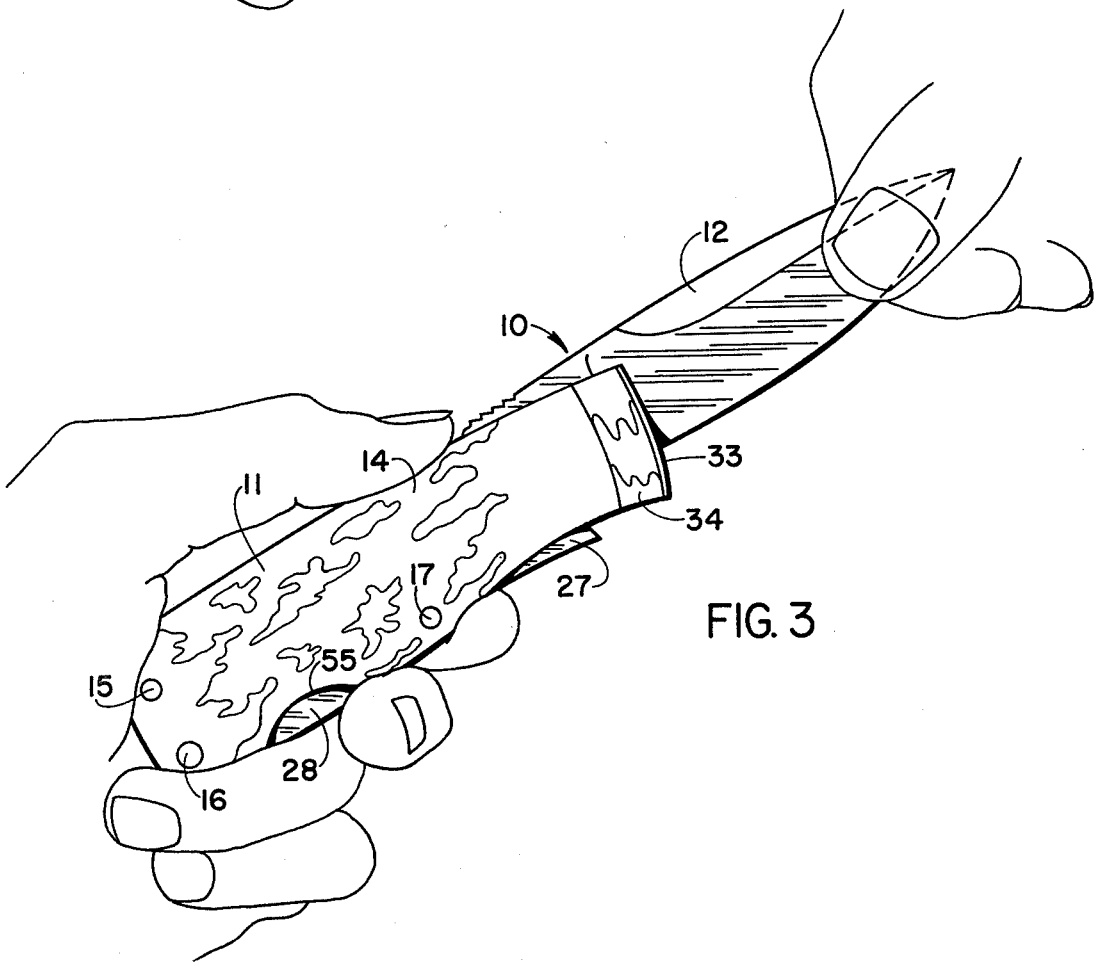

FIG. 2 corresponds with FIG. 6 in illustrating the position of blade 12 relative to handle 11 during movement of the blade both inwardly and outwardly relative to the handle and FIG. 3 corresponds to FIG. 7 in illustrating the relative positions of the handle 11 and blade 12 as the blade 12 moves between its extreme positions.

Figure 10:
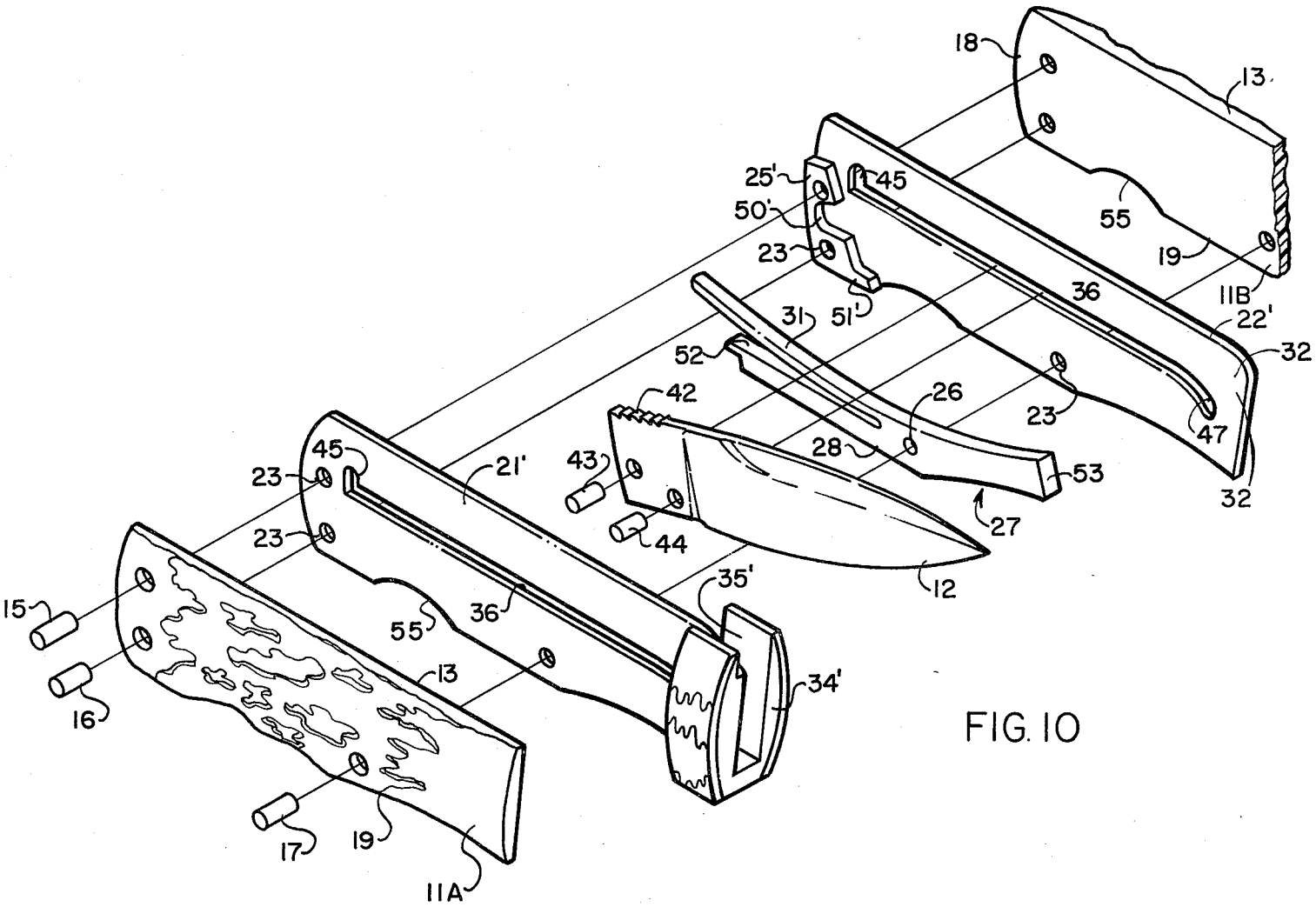
FIG. 10 is an exploded perspective view of a modified form of the invention wherein the bolster and one liner are formed integral with each other and the other liner and the abutment are formed integral with each other.

Referring now to the modified form illustrated in FIG. 10, wherein like reference numbers are used with the prime notation added to identify like parts, the liner 21' may be cast integral with bolster 34' and the other liner 22' may be cast integral with abutment 25' to effect economics in manufacturing. If desired, the bolster 34', abutment 25' and both liners 21' and 22' may all be cast together as an integral unit. The integrated structure also offers the advantage of greater strength.

In both forms of the invention, the bolster 34 or 34' relies on its rugged monolithic construction to hold the front of the knife together, because unlike the conventional bolster it is not held by a transversely extending pin. The space within the bolster 34 and 34' is free and unobstructed to permit reciprocal movement of blade 12.

Although specific terms have been employed in the specification they are used in a descriptive sense only and not for purposes of limitation.

I claim:

1. A knife comprising a handle and a blade mounted within the handle and selectively movable into fully extended operative position beyond the handle and into fully retracted or inoperative position within the handle, said knife including spring means fixed within the handle beneath the blade and extending axially along the length of the knife, and blade having a butt portion and means supporting the butt of the blade for axial movement in continuous engagement with said spring between the fully retracted inoperative position and the fully extended operative position of the blade, said means supporting the butt of the blade comprising a liner on each side of the blade, said liners having longitudinally extending slots defining a trackway and first and second guide pins fixed to the butt of the blade and extending through the slots in the liner.

2. A knife according to claim 1 wherein said trackway has a stop position at each of its ends and said spring includes means for urging the blade into positively locked position at each stop position.

3. A knife according to claim 2 wherein said last named means includes a leaf spring normally urging said first guide pin upwardly into the innermost stop position.

4. A knife according to claim 3 wherein said spring includes a planar forward surface engageable with the rear surface of the blade to retain the second guide pin in the forward stop position.

5. A knife according to claim 4 and including means supporting the spring for pivotal movement about a transverse axis responsive to axial movement of the blade between said stop positions.

6. A knife according to claim 1 including means supporting the spring for pivotal movement about a transverse axis responsive to axial movement of the blade beyond said pivot means.

7. A knife according to claim 1 wherein said trackway includes an inner stop position at the rear of the knife and an outer stop position at the front of the knife, said inner stop position comprising an acute angular extension of the trackway and said outer stop position comprising an obtuse angular extension of the trackway, and said trackway extending axially of the knife between said stop positions.

8. A knife according to claim 1 including means for pivoting the spring about a transverse axis at its medial portion, an abutment within the handle and fixed thereto, said abutment being located at the rear of the handle and having a recess opening toward the front of the handle, said spring means including a leaf spring having a free end received within the recess and normally urged into engagement with one wall of the recess to normally elevate the other end of the spring into abutting relation with the blade in its fully extended operative position.

9. A knife according to claim 1 wherein a bolster surrounds the front of the handle, and said bolster being of a cross-sectional U-shaped configuration and having an open top through which the blade moves as it traverses the handle.

10. A method of supporting a knife blade in elevated angular disposition for reciprocatory movement longitudinally of a handle for the blade, said method comprising the steps of defining a trackway including a medial portion extending axially of the handle and including a transversely extending inner end portion and an angularly extending outer end portion, providing a pair of offset guide pins mounting the blade for movement along the trackway in angular relation to the handle, and providing resilient means normally locking the blade in a selected stop position.

11. A knife comprising a handle and a blade mounted within the handle and selectively movable in angular relation to the longitudinal axis of the handle and into operative and inoperative positions in parallel relation to the longitudinal axis of the handle, said knife including a one-piece integrated bolster of cross-sectional U-shaped configuration and having an open end through which the blade passes as it moves in angular relation to the handle between the operative and inoperative positions.

12. A knife comprising a handle and a blade mounted within the handle and selectively movable into fully extended operative position beyond one end of the handle and into fully retracted or inoperative position within the handle, said knife including a pair of liners arranged in spaced parallel relation to each other on opposite sides of the knife blade and each liner having a trackway for guiding the blade along a predetermined path of travel, means mounting the blade in the trackways for supporting the blade in angular relation to the handle and for axial movement relative to the liners, a bolster at the said one end of the handle, said bolster having a U-shaped configuration in corss-section and being formed from a single piece of material and including a web and a pair of legs extending in spaced parallel relation to each other from the web and said bolster having an opening in its end opposite the web to receive said blade, and resilient means supporting said blade for movement between said operative and inoperative positions.

13. A knife comprising a handle and a blade mounted within the handle and selectively movable into fully extended operative position beyond the handle and into fully retracted or inoperative position within the handle, said blade having a butt portion and means supporting the butt of the blade for axial movement in angular relation to the handle between the fully retracted inoperative position and the fully extended operative position of the blade, and said means supporting the butt of the blade comprising first and second guide pins fixed in offset relation to each other to the butt of the blade, a longitudinally extending trackway within the handle and means mounting the guide pins for slidable movement along the trackway.

14. A knife comprising a handle and a blade mounted within the handle and selectively movable into fully extended operative position beyond the handle and into fully retracted or inoperative position within the handle, said blade having a butt portion and means supporting the butt of the blade in angular relation to the handle for axial movement between the fully retracted inoperative position and the fully extended operative position of the blade, and said means supporting the butt of the blade comprising a liner on at least one side of the blade and having a longitudinally extending slot defining a trackway and first and second guide pins fixed to the butt of the blade and extending through the slot in the liner.

* * * * *